US009334746B2

(12) United States Patent
Sankolli et al.

(10) Patent No.: US 9,334,746 B2
(45) Date of Patent: May 10, 2016

(54) TURBOMACHINE FLOW DIVIDER AND RELATED TURBOMACHINE

(71) Applicant: General Electric Company, Schenectady, NY (US)

(72) Inventors: Prashant Prabhakar Sankolli, Curti (IN); Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 730 days.

(21) Appl. No.: 13/692,541

(22) Filed: Dec. 3, 2012

(65) Prior Publication Data

US 2014/0154065 A1 Jun. 5, 2014

(51) Int. Cl.
*F03B 11/02* (2006.01)
*F01D 9/04* (2006.01)

(52) U.S. Cl.
CPC ..... *F01D 9/041* (2013.01); *F01D 9/047* (2013.01); *F05D 2220/31* (2013.01); *F05D 2230/26* (2013.01)

(58) Field of Classification Search
CPC ..... F01D 3/00; F01D 3/02; F01D 3/025; F01D 9/00; F01D 9/02
USPC ..... 415/209.2
See application file for complete search history.

(56) References Cited

U.S. PATENT DOCUMENTS

| | | | | |
|---|---|---|---|---|
| 5,249,918 | A * | 10/1993 | Knorowski | F01D 3/02 415/108 |
| 5,295,301 | A | 3/1994 | Knorowski | |
| 7,322,789 | B2 | 1/2008 | Burdgick | |
| 7,357,618 | B2 | 4/2008 | Burdgick et al. | |
| 7,874,795 | B2 | 1/2011 | Burdgick et al. | |
| 2007/0104572 | A1 * | 5/2007 | Burdgick | F01D 3/02 415/198.1 |
| 2012/0020775 | A1 * | 1/2012 | Sankolli | F01D 9/02 415/145 |
| 2012/0128465 | A1 | 5/2012 | Burdgick et al. | |

* cited by examiner

*Primary Examiner* — Dwayne J White
*Assistant Examiner* — Jason Mikus
(74) *Attorney, Agent, or Firm* — Ernest G. Cusick; Hoffman Warnick LLC

(57) ABSTRACT

Various embodiments include a turbomachine flow divider. In various particular embodiments, a flow divider for connecting with a first inner diaphragm ring and a second inner diaphragm ring of a turbomachine includes: a body section; and a pair of axially extending flanges extending from the body section, each of the axially extending flanges for engaging with the first inner diaphragm ring and the second inner diaphragm ring, respectively, wherein the flow divider is formed substantially of a rolled plate metal or a sheet metal.

15 Claims, 3 Drawing Sheets

TURBOMACHINE FLOW DIVIDER AND RELATED TURBOMACHINE

FIELD OF THE INVENTION

The subject matter disclosed herein relates to power systems. More particularly, the subject matter relates to turbomachine systems.

BACKGROUND OF THE INVENTION

Conventional turbomachines (also referred to as turbines), such as steam turbines (or, steam turbomachines), generally include static nozzle assemblies that direct the flow of working fluid (e.g., steam) into rotating buckets that are connected to a rotor. In steam turbines the nozzle (or, airfoil) construction is typically called a "diaphragm" or "nozzle assembly" stage. Nozzle assemblies are assembled in two halves around the rotor, creating a horizontal joint.

In a double-flow (or dual-flow) steam turbine, inlet steam is directed through an inlet passageway and divided (split) into two axial passageways connecting with a first and second side of the turbine. Conventionally, the flow is divided using a structure called a flow splitter. After the steam flow is divided, the steam flows axially in opposite directions through the nozzle/bucket stages of each side of the turbine.

Some conventional flow splitter designs include large, heavy and costly structures which include two mirror image-like axial halves that are bolted together through large flanges. The bolt is traditionally aligned on an inside radial surface of the axial halves, between the flow splitter and the rotor body. Each half of the flow splitter is conventionally machined from a large forging, which results in a significant amount of stock material being wasted during the forging process. In other conventional flow splitter designs, a unitary splitter structure is formed and then machined to include hooks for engaging complementary hooks on the diaphragm and maintaining a radial and axial position of the flow splitter. However, the process of forming this unitary structure, e.g., via forging and subsequent machining, can be complicated and time consuming. Additionally, the hooks of these conventional flow splitters also react with a portion of the axial pressure force on the nozzle stage, which can cause maintenance related issues after the turbine has operated for an extended period.

BRIEF DESCRIPTION OF THE INVENTION

Various embodiments include a turbomachine flow divider. In various particular embodiments, a flow divider for connecting with a first inner diaphragm ring and a second inner diaphragm ring of a turbomachine is disclosed. The flow divider includes: a body section; and a pair of axially extending flanges extending from the body section, each of the axially extending flanges for engaging with the first inner diaphragm ring and the second inner diaphragm ring, respectively, wherein the flow divider is formed substantially of a rolled plate metal or a sheet metal.

A first aspect of the invention includes a flow divider for connecting with a first inner diaphragm ring and a second inner diaphragm ring of a turbomachine. The flow divider includes: a body section; and a pair of axially extending flanges extending from the body section, each of the axially extending flanges for engaging with the first inner diaphragm ring and the second inner diaphragm ring, respectively, wherein the flow divider is formed substantially of a rolled plate metal or a sheet metal.

A second aspect of the invention includes a turbomachine diaphragm section having: a first diaphragm stage in a first turbomachine section, the first diaphragm stage having a first inner diaphragm ring and a first outer diaphragm ring; a second diaphragm stage in a second turbomachine section opposing the first turbomachine section, the second diaphragm stage having a second inner diaphragm ring and a second outer diaphragm ring; a flow divider connected with the first inner diaphragm ring and the second inner diaphragm ring for dividing flow of a working fluid into each of the first diaphragm stage and the second diaphragm stage, the flow divider including: a body section having a substantially planar radially outer surface; and a pair of axially extending flanges extending from the body section, each flange engaging with the first inner diaphragm ring and the second inner diaphragm ring, respectively; and a set of key members proximate a horizontal joint of the flow divider between at least one of the pair of axially extending flanges and at least one of the first inner diaphragm ring or the second inner diaphragm ring.

A third aspect of the invention includes a dual-flow turbomachine including: a first section having a first diaphragm stage with a first inner diaphragm ring and a first outer diaphragm ring; a second section opposing the first section, the second section having a second diaphragm stage with a second inner diaphragm ring and a second outer diaphragm ring; a flow divider connected with the first inner diaphragm ring and the second inner diaphragm ring for dividing flow of a working fluid into each of the first diaphragm stage and the second diaphragm stage, the flow divider including: a body section having a substantially planar radially outer surface; and a pair of axially extending flanges extending from the body section, each flange engaging with the first inner diaphragm ring and the second inner diaphragm ring, respectively; and a set of key members proximate a horizontal joint of the flow divider between at least one of the pair of axially extending flanges and at least one of the first inner diaphragm ring or the second inner diaphragm ring.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
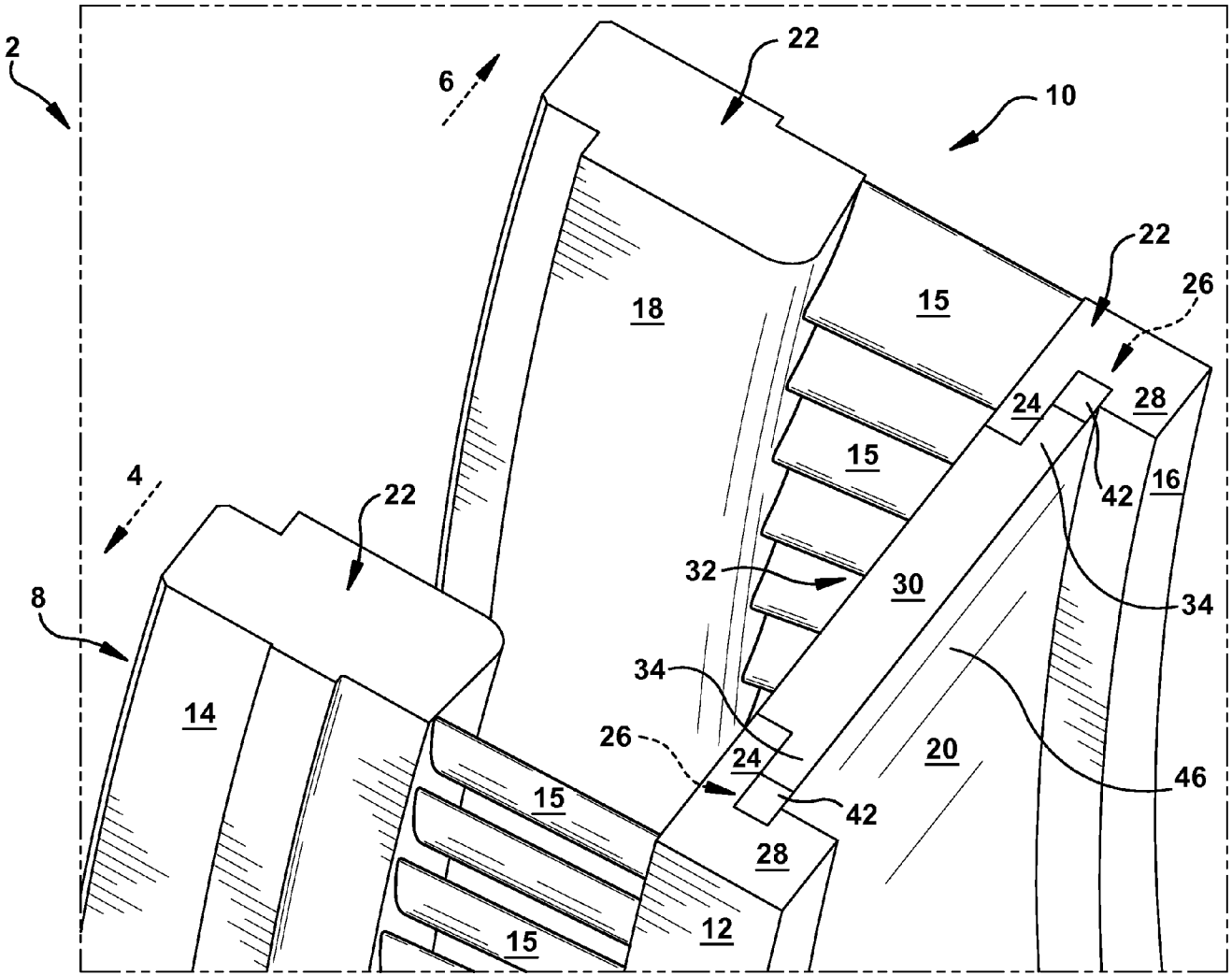
FIG. 1 shows a three-dimensional perspective view of a portion of a turbomachine diaphragm section according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems. More particularly, the subject matter relates to turbomachine systems.

As described herein, some conventional flow splitter designs include large, heavy and costly structures which include two mirror image-like axial halves that are bolted together through large flanges. The bolt is traditionally aligned on an inside radial surface of the axial halves, between the flow splitter and the rotor body. Each half of the flow splitter is conventionally machined from a large forging, which results in a significant amount of stock material being wasted during the forging process. In other conventional flow splitter designs, a unitary splitter structure is formed and then machined to include hooks for engaging complementary hooks on the diaphragm and maintaining a radial position of the flow splitter. However, the process of forming this unitary structure, e.g., via forging and subsequent machining, can be complicated and time consuming. Another issue with the conventional flow splitter design is that the hooks can cause difficulty in assembling the flow splitter and adjacent diaphragm stages, and these flow splitters are difficult to disassemble after a period of operation, e.g., once corrosion and oxidation has occurred.

Various embodiments include a turbomachine flow divider. In various particular embodiments, a flow divider for connecting with a first inner diaphragm ring and a second inner diaphragm ring of a turbomachine is disclosed. The flow divider includes: a body section; and a pair of axially extending flanges extending from the body section, each of the axially extending flanges for engaging with the first inner diaphragm ring and the second inner diaphragm ring, respectively, wherein the flow divider is formed substantially of a rolled plate metal or a sheet metal.

Various particular embodiments of the invention include a turbomachine diaphragm section having: a first diaphragm stage in a first turbomachine section, the first diaphragm stage having a first inner diaphragm ring and a first outer diaphragm ring; a second diaphragm stage in a second turbomachine section opposing the first turbomachine section, the second diaphragm stage having a second inner diaphragm ring and a second outer diaphragm ring; a flow divider connected with the first inner diaphragm ring and the second inner diaphragm ring for dividing flow of a working fluid into each of the first diaphragm stage and the second diaphragm stage, the flow divider including: a body section having a substantially planar radially outer surface; and a pair of axially extending flanges extending from the body section, each of the flanges engaging with the first inner diaphragm ring and the second inner diaphragm ring, respectively; and a set of key members proximate a horizontal joint of the turbomachine diaphragm section between at least one of the pair of axially extending flanges and at least one of the first inner diaphragm ring or the second inner diaphragm ring.

Various other particular embodiments of the invention include a dual-flow turbomachine having: a first section having a first diaphragm stage with a first inner diaphragm ring and a first outer diaphragm ring; a second section opposing the first section, the second section having a second diaphragm stage with a second inner diaphragm ring and a second outer diaphragm ring; a flow divider connected with the first inner diaphragm ring and the second inner diaphragm ring for dividing flow of a working fluid into each of the first diaphragm stage and the second diaphragm stage, the flow divider including: a body section having a substantially planar radially outer surface; and a pair of axially extending flanges extending from the body section, each of the flanges engaging with the first inner diaphragm ring and the second inner diaphragm ring, respectively; and a set of key members proximate a horizontal joint of the dual-flow turbomachine between at least one of the pair of axially extending flanges and at least one of the first inner diaphragm ring or the second inner diaphragm ring.

Various other particular embodiments of the invention include a dual-flow turbomachine having: an inlet; a first section fluidly connected with the inlet and extending axially from the inlet in a first direction, the first section having a first diaphragm stage with a first inner diaphragm ring and a first outer diaphragm ring; a second section fluidly connected with the inlet and extending axially from the inlet in a second direction opposite the first direction, the second section having a second diaphragm stage with a second inner diaphragm ring and a second outer diaphragm ring; a flow divider connected with the first inner diaphragm ring and the second inner diaphragm ring for dividing flow of a working fluid from the inlet into each of the first diaphragm stage and the second diaphragm stage, the flow divider including: a body section having a substantially planar radially outer surface; and a pair of axially extending flanges extending from the body section, each of the flanges engaging with the first inner diaphragm ring and the second inner diaphragm ring, respectively, wherein the flow divider includes one of a rolled plate metal or a sheet metal; and a set of key members proximate a horizontal joint of the dual-flow turbomachine between each of the pair of axially extending flanges and each of the first inner diaphragm ring and the second inner diaphragm ring.

As used herein, the terms "axial" and/or "axially" refer to the relative position/direction of objects along axis A, which is substantially perpendicular to the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (C) which surrounds axis A but does not intersect the axis A at any location.

Turning to FIG. 1, a three-dimensional perspective view of a portion of a turbomachine diaphragm section 2 (e.g., a steam turbine diaphragm section) is shown according to various embodiments of the invention. The turbomachine diaphragm section 2 can form part of a dual-flow steam turbine, which as described herein, has a first section 4 and a second section 6 (illustrated by arrows) which extend axially, in opposite directions from an inlet or flow divider section (shown in FIG. 1).

In various embodiments, the turbomachine diaphragm section 2 can include a first diaphragm stage 8 in the first turbomachine section 4, and a second diaphragm stage 10 in the second turbomachine section 6. The first diaphragm stage 8 has a first inner diaphragm ring 12 and a first outer diaphragm ring 14. Between the first inner diaphragm ring 12 and the first outer diaphragm ring 14 sit a set of nozzles (or nozzle blades) 15, which help to direct working fluid toward the flow path of a first set of rotor buckets (not shown), as is known in the art. The second diaphragm stage 10 has a second inner diaphragm ring 16 and a second outer diaphragm ring 18. Between the second inner diaphragm ring 16 and the second outer diaphragm ring 18 sit a set of nozzles (or nozzle blades), which help to direct working fluid toward the flow path of a second set of rotor buckets (not shown), as is known in the art.

Figure 2:
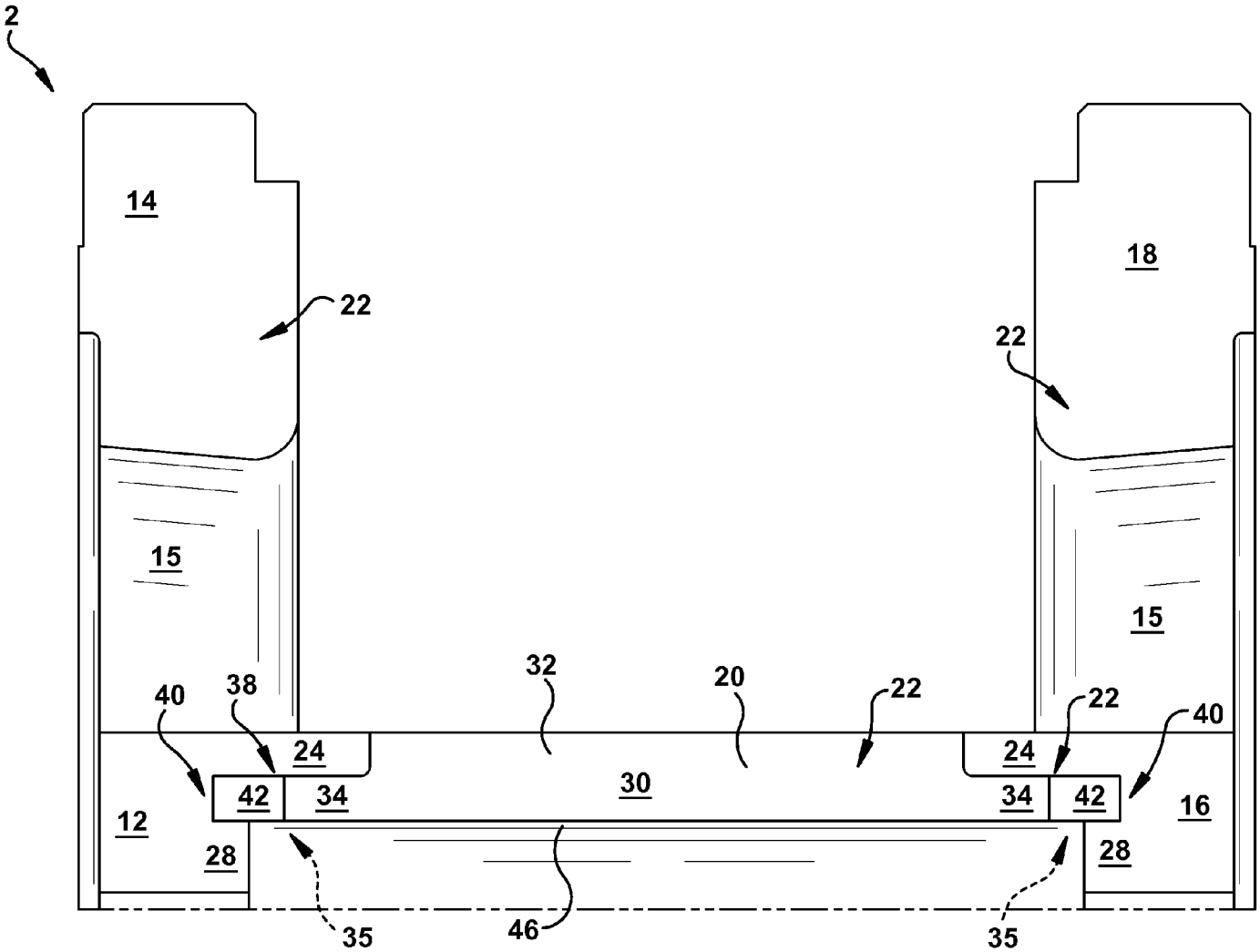
FIG. 2 shows an end view of the turbomachine diaphragm section of FIG. 1 from the horizontal joint, according to various embodiments of the invention.

Also shown in FIG. 1, the turbomachine diaphragm section 2 includes a flow divider 20 connected with the first inner diaphragm ring 12 and the second inner diaphragm ring 16. The flow divider 20 is positioned to divide flow of a working fluid (e.g., inlet steam) into each of the first diaphragm stage 8 and the second diaphragm stage 10. FIG. 2 shows a close-up end view of the portion of the turbomachine diaphragm section 2 from a horizontal end joint of the turbomachine (which includes diaphragm section 2). As is known in the art, a turbomachine diaphragm section is formed in two halves joined at a horizontal joint surface 22 (FIG. 1 and FIG. 2), which surrounds the body of a turbomachine rotor (not shown). The horizontal joint surface 22 is referenced with respect to each of the components of the diaphragm section 2 which have a surface at the horizontal joint. That is, as referenced herein, the "horizontal joint surface" of a particular component is the surface of that component which sits at the horizontal joint of the diaphragm section 2. Depictions of the diaphragm sections herein exclude some features of a conventional turbomachine to enhance illustration of the various embodiments of the invention. However, it is noted that one having skill in the art will appreciate that an upper half of the turbomachine diaphragm can have substantially similar features as described with respect to the lower half of the turbomachine diaphragm, and that the diaphragm section 2 shown and described herein can depict either an upper half or a lower half of a turbomachine diaphragm section.

Returning to FIGS. 1-2, the first inner diaphragm ring 12 and the second inner diaphragm ring 16 each include a step 24 and an adjacent slot 26 (shown with phantom arrows) each extending circumferentially along each of the first inner diaphragm ring 12 and the second inner diaphragm ring 16, respectively. The slot 26 may be located radially between the step 24 and a radially inner wall 28 of each ring 12, 16, respectively. The step 24 may extend farther axially than the radially inner wall 28 toward the opposing inner diaphragm ring, e.g., the step 24 on the first inner diaphragm ring 12 may extend farther toward the second inner diaphragm ring 16 than the radially inner wall 28 of the first inner diaphragm ring 12. As will be described herein, the step 24 can act to retain the flow divider 20 radially, and the step 24 can engage a flange from the flow divider 20.

It is understood that in various alternate embodiments, the radially inner wall 28 may be recessed such that each of the inner diaphragm rings 12, 16 do not include a radially inner wall 28. This alternate embodiment is depicted in phantom in FIG. 2. In this case, the axially inner surface 40 of the slot 26 fits flush with radially inner portion of each of the diaphragm rings 12, 16. In these embodiments, the flow divider 20 can be retained radially by the step 24, and axially by the axially inner surface 40 of the slot 26.

The flow divider 20 can include a body section 30, which in some cases can include a substantially planar radially outer surface 32, and a pair of axially extending flanges 34 each engaging with the first inner diaphragm ring 12 and the second inner diaphragm ring 16. In particular, one of the pair of axially extending flanges 34 can engage with (e.g., contact) each step 24 of the first inner diaphragm ring 12 and second diaphragm ring 16, respectively. As described herein, in various embodiments, the substantially planar radially outer surface 32 may serve as the contact surface for the flow of working fluid (e.g., steam) into the turbomachine. That is, the substantially planar radially outer surface 32 may serve to divert the flow of the working fluid toward the first turbomachine section 4 and second turbomachine section 6, respectively. The axially extending flanges 34 can extend from the body section 30 axially in opposite directions (toward the first turbomachine section 4 and second turbomachine section 6, respectively). As noted, these flanges 34 can contact the step of each of the inner diaphragm rings 12, 16. In various embodiments, these flanges 34 can each include a notch 35 (FIG. 2), which extends circumferentially from the horizontal joint surface 22 of the body section 30. These notches 35 can be sized to fit a key member (42, described further herein), and in some cases, may have a depth of approximately 2.5-15 centimeters (approximately 1-6 inches) measured from the horizontal joint surface 22 of the body 22.

Proximate the horizontal joint 22, the notch 35 (shown in phantom in FIG. 2) forms a gap between the axial end 38 of each flange 34 and the axially inner surface 40 of the slot 26. As shown, the notch 35 is substantially filed with a key member 42 from a set of key members 42. In this case, the term "set" means at least one (e.g., at least one key member 42). As shown in FIGS. 1-2, each key member 42 in the set is located proximate the horizontal joint 22 between one of the pair of axially extending flanges 34 and the inner diaphragm rings 12, 16, respectively. The key member 42 can be formed of a metal such as steel or iron, an alloy, and/or a composite. The key member may be approximately as thick as one of the flanges 34, and may have a thickness less than the body 30 of the flow divider 20. As shown, the gap 36 (filled by the key member 42 in these depictions, extends a small distance (e.g., 2.5-15 centimeters or fewer) from the horizontal joint surface 22. The slot 26 can house a portion of the key member 42, such that a portion of the key member 42 extends axially from the slot 26. In various embodiments, the key member(s) 42 can restrict movement of the flow divider 20 relative to the inner diaphragm rings 12, 16, respectively. In various embodiments, a pair of key members 42 are utilized at each horizontal joint of the diaphragm section half (where a complete annulus diaphragm section would utilize four key members 42).

In various embodiments, the flow divider 20 can be formed from a rolled plate metal or a sheet metal. That is, the flow divider 20 can be formed without substantially machining or forging, and can be installed between the first diaphragm stage 8 in the first turbomachine section 4, and a second diaphragm stage 10. In some cases, where the flow divider 20 includes a sheet metal, the sheet metal has a thickness of at least 5 centimeters. The radially inner surface 46 of the flow divider 20 (opposite the radially outer surface 32) can be substantially free of machining in various embodiments, and in some embodiments, both the radially inward surface 46 and the radially outer surface 32 of the flow divider 20 are substantially free of machining.

It is understood that in various alternate embodiments, however, that a traditional protruding flow splitter, in the form of a peak, apex, flange, etc. can be integrated with the various embodiments of the flow divider 20. In these alternate embodiments, a peak or flange may be formed from a separate piece of metal and welded or brazed to the flow divider 20 circumferentially about the diaphragm section 2. This peak or flange could be used to aid in directing the flow of working fluid (steam) into the first diaphragm stage 8 and the second diaphragm stage 10.

Figure 3:
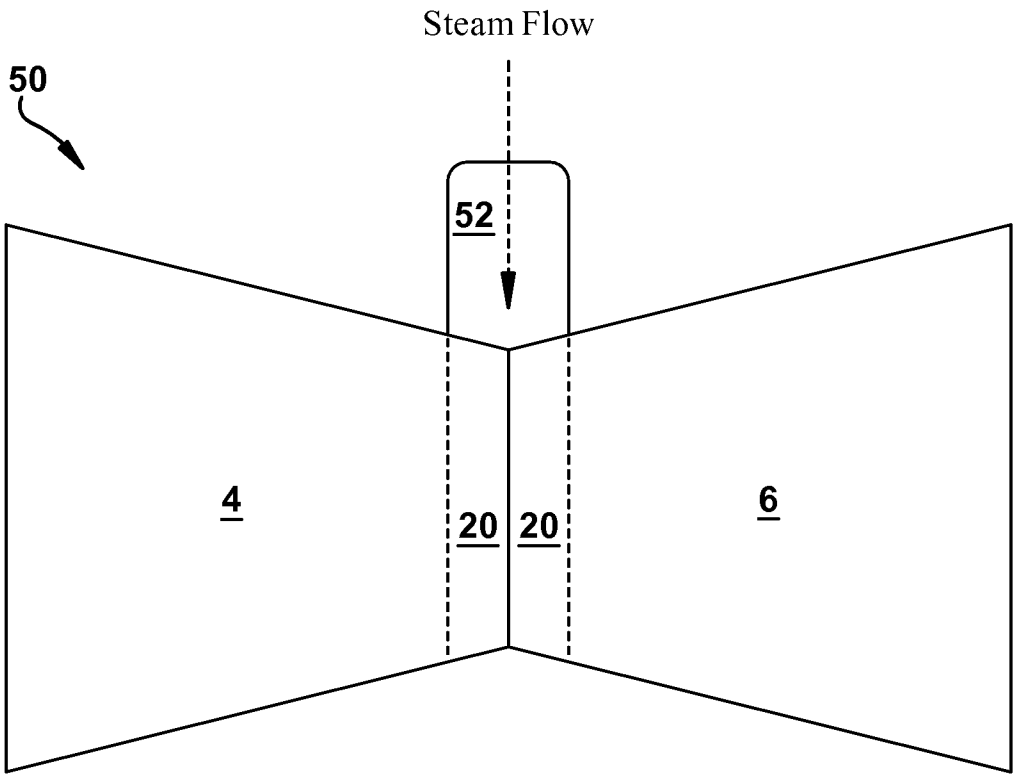
FIG. 3 shows a dual-flow turbomachine according to various embodiments of the invention.

FIG. 3 shows a schematic depiction of a dual-flow turbomachine 50 including the first turbomachine section 4 and the second turbomachine section 6 described herein. The dual-flow turbomachine 50 can include an inlet 52, e.g., a central inlet, which provides a working fluid such as steam to an axial central location of the dual-flow turbomachine. The inlet 52 is fluidly connected with the first turbomachine section 4 and the second turbomachine section 6, as is known in the art. Shown in phantom is the flow divider 20 shown and described according to various embodiments of the invention. As described herein, the flow divider 20 can divert the flow of inlet fluid (e.g., steam) from the inlet 52 to each of the first turbomachine section 4 and the second turbomachine section 6.

The flow divider 20 shown and described according to the various embodiments of the invention can perform the flow dividing (or splitting) functions of conventional flow dividers used in turbomachinery, however, the flow divider 20 can require significantly less machining than conventional flow dividers. In some cases, the flow divider 20 includes surfaces which do not require machining. In some embodiments, the flow divider 20 can be formed of a rolled plate metal, a sheet metal, or other suitable metals which can perform the functions described herein. The flow divider 20 can be retained and restricted from rotation by one or more key members, which can be inserted in slots within the flow divider 20 and the diaphragm ring to restrict radial and/or circumferential movement of the flow divider 20.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A turbomachine diaphragm section comprising:

a first diaphragm stage in a first turbomachine section, the first diaphragm stage having a first inner diaphragm ring and a first outer diaphragm ring;

a second diaphragm stage in a second turbomachine section opposing the first turbomachine section, the second diaphragm stage having a second inner diaphragm ring and a second outer diaphragm ring;

a flow divider connected with the first inner diaphragm ring and the second inner diaphragm ring for dividing flow of a working fluid into each of the first diaphragm stage and the second diaphragm stage, the flow divider including:

a body section having a substantially planar radially outer surface; and a pair of axially extending flanges extending from the body section, each axially extending flange engaging with the first inner diaphragm ring and the second inner diaphragm ring, respectively, wherein the flow divider has a radially inner surface, opposite the substantially planar radially outer surface, extending between the body section and the pair of axially extending flanges; and a set of key members proximate a horizontal joint surface of the flow divider between at least one of the pair of axially extending flanges and at least one of the first inner diaphragm ring or the second inner diaphragm ring, wherein the radially inner surface is coplanar with a radially inner surface of each of the set of key members, and wherein a portion of each of the set of key members is radially exposed adjacent the radially inner surface.

2. The turbomachine diaphragm section of claim 1, wherein the first inner diaphragm ring and the second inner diaphragm ring each include a slot housing a portion of a key member from the set of key members.

3. The turbomachine diaphragm section of claim 2, wherein the first inner diaphragm ring and the second inner diaphragm ring each include a step engaging one flange from the pair of axially extending flanges of the flow divider.

4. The turbomachine diaphragm section of claim 1, wherein the flow divider includes a rolled plate metal or a sheet metal.

5. The turbomachine diaphragm section of claim 4, wherein in the case that the flow divider includes sheet metal, the sheet metal has a thickness of at least 5 centimeters.

6. The turbomachine diaphragm section of claim 1, wherein the radially inner surface is free of machining.

7. The turbomachine diaphragm section of claim 1, wherein the set of key members restricts rotation of the flow divider relative to the first diaphragm stage and the second diaphragm stage.

8. A dual-flow turbomachine comprising:

a first section having a first diaphragm stage with a first inner diaphragm ring and a first outer diaphragm ring;

a second section opposing the first section, the second section having a second diaphragm stage with a second inner diaphragm ring and a second outer diaphragm ring;

a flow divider connected with the first inner diaphragm ring and the second inner diaphragm ring for dividing flow of a working fluid into each of the first diaphragm stage and the second diaphragm stage, the flow divider including:

a body section having a substantially planar radially outer surface; and a pair of axially extending flanges extending from the body section, each axially extending flange engaging with the first inner diaphragm ring and the second inner diaphragm ring, respectively, wherein the flow divider has a radially inner surface, opposite the substantially planar radially outer surface, extending between the body section and the pair of axially extending flanges; and a set of key members proximate a horizontal joint surface of the flow divider between at least one of the pair of axially extending flanges and at least one of the first inner diaphragm ring or the second inner diaphragm ring, wherein the radially inner surface is coplanar with a radially inner surface of each of the set of key members, and wherein a portion of each of the set of key members is radially exposed adjacent the radially inner surface.

9. The dual-flow turbomachine of claim 8, wherein the first inner diaphragm ring and the second inner diaphragm ring each include a slot housing a portion of a key member from the set of key members.

10. The dual-flow turbomachine of claim 9, wherein the first inner diaphragm ring and the second inner diaphragm ring each include a step engaging one flange from the pair of axially extending flanges of the flow divider.

11. The dual-flow turbomachine of claim 8, wherein the flow divider includes a rolled plate metal or a sheet metal.

12. The dual-flow turbomachine of claim 11, wherein, in the case that the flow divider includes sheet metal, the sheet metal has a thickness of at least 5 centimeters.

13. The dual-flow turbomachine of claim 8, wherein the radially inner surface is free of machining.

14. The dual-flow turbomachine of claim 8, wherein the set of key members restricts rotation of the flow divider relative to the first diaphragm stage and the second diaphragm stage.

15. The dual-flow turbomachine of claim 8, further comprising:

a first set of nozzles extending between the first inner diaphragm ring and the first outer diaphragm ring; and a second set of nozzles extending between the second inner diaphragm ring and the second outer diaphragm ring, wherein the flow divider is positioned to divert the working fluid to each of the first set of nozzles and the second set of nozzles.

* * * * *